United States Patent [19]

Wire et al.

[11] 3,958,704

[45] May 25, 1976

[54] PIPE LAYING ATTACHMENT

[76] Inventors: Philip J. Wire, 4134 Auxarms Drive, Apt. 2, Memphis, Tenn. 38128; James M. Stephenson, 3228 Lichen Drive, Bartlett, Tenn. 38134

[22] Filed: Jan. 27, 1975

[21] Appl. No.: 544,177

[52] U.S. Cl. ..... 214/130 C; 214/147 R

[51] Int. Cl.[2] ..... B66F 9/00

[58] Field of Search ..... 214/147 R, 130 C, 147 T, 214/DIG. 4, 2.5, 1 P, 1 PA, 138 R

[56] References Cited

UNITED STATES PATENTS

| | | | |
|---|---|---|---|
| 3,669,293 | 6/1972 | Bryan | 214/147 R |
| 3,834,566 | 9/1974 | Hilfiker | 214/130 C |

*Primary Examiner*—Philip Goodman
*Attorney, Agent, or Firm*—Joseph L. Spiegel

[57] ABSTRACT

A pipe carrying and laying attachment for heavy construction equipment such as backhoes, excavation shovels and the like comprises a support frame which includes a plurality of radially extending arms projecting therefrom, the terminal ends of the arms carrying support shoes. The frame is adapted for fitting interiorly of large diameter, heavy pipe such as concrete pipe having a diameter of from ten to twelve feet. At least one of the radially extending arms includes an actuator for adjusting the radial position of the associated support shoe on the arm thereby providing radial pressure on the interior of the pipe for gripping of same.

The purpose of this abstract is to enable the Public and the Patent Office to determine rapidly the subject matter of the technical disclosure of the application. This abstract is not intended to define the invention of the application nor is it intended to be limiting as to the scope thereof.

15 Claims, 6 Drawing Figures

PIPE LAYING ATTACHMENT

SUMMARY OF THE INVENTION AND STATE OF THE PRIOR ART

The present invention relates to an attachment for construction or excavation equipment and more particularly relates to a pipe carrying and laying attachment for heavy construction equipment such as backhoes, shovels, and the like for grasping large diameter, heavy pipe and lowering the pipe for correct placement in an excavation or trench.

Concrete conduits or pipe sections of relatively large diameter, on the order of ten to twelve feet and weighing approximately two tons, have commonly been lifted by movable supports or booms on bulldozers, heavy duty backhoes or other earth excavation equipment like power shovels. Conventionally, the lifting has been accomplished by placing a lifting hook on the terminal end of a hoisting cable over the edge of the pipe, frequently resulting in breakage of the concrete pipe due to the leverage of the hook. Another commonly employed method of moving such heavy pipe sections is to wrap a loop of chain around the wall of the pipe sections or through the center of the pipe section and then utilizing the lifting action of a crane or the like, moving the pipe section into the trench or excavation. Once in the excavation, the pipe must be manhandled into position for coaxial, abutting alignment with adjacent pipe sections. Once again, however, the pressure of the chain at opposite longitudinal or side edges results in damage due to the pressure of the chain. Still other methods have been employed for picking up and laying pipe sections, for example, the pipe may be cast or otherwise molded or formed with provisions for attachment of an eyelet or hook for engagement in the hook of a hoist cable. However, this method also often results in breakage because the entire weight of the pipe is supported at the single localized point of attachment of the eyelet to the pipe. Moveover, because of the deficiencies and chance and risk of breakage of the pipe, other techniques for laying such large concrete pipe have been employed. U.S. Pat. No. 2,881,928 to Morris, issued on Apr. 14, 1959, discloses a pipe laying and transporting device for use in conjunction with bulldozers and the like. The device of Morris includes a pipe supporting cradle which is pivotally mounted on a bracket member to be carried by a vertically movable boom or support on the bulldozer. The cradle is provided with a generally flat upper surface for supporting the pipe sections. However, such a structure as provided by Morris has its shortcomings, for example, the tendency of the pipe section to slide from the pivotally mounted support for the pipe. Additionally the Morris type attachment is specifically designed for use with construction equipment such as a bulldozer and is difficult to use with heavy construction equipment which is designed to operate in a trench or excavation and move pipe from an overhead level down onto the floor of the trench.

In view of the above it is a principal object of the present invention to provide a novel pipe carrying and laying attachment for heavy construction equipment and specifically adapted to firmly grip, carry and lay large diameter pipe without damage to same.

Another object is a pipe carrying and laying attachment which may be quickly connected to excavation equipment such as a backhoe and the like for carrying and laying such heavy section of pipe.

Still another object is a pipe carrying and laying attachment which may be utilized to enter a large diameter pipe, and under operator control expand to grip the pipe internally for elevating the pipe from a rest position on earth or ground level to the level of the trench or bottom of the excavation.

A further object of the present invention is to provide a pipe carrying and laying attachment for heavy construction or excavation equipment in which attachment the position of pipe being carried thereby may be adjusted in the hole or excavation by power assist on the attachment, and by operator control.

Other objects and a more complete understanding of the invention may be had by referring to the following specification and claims taken in conjunction with the accompanying drawing in which:

Figure 1:
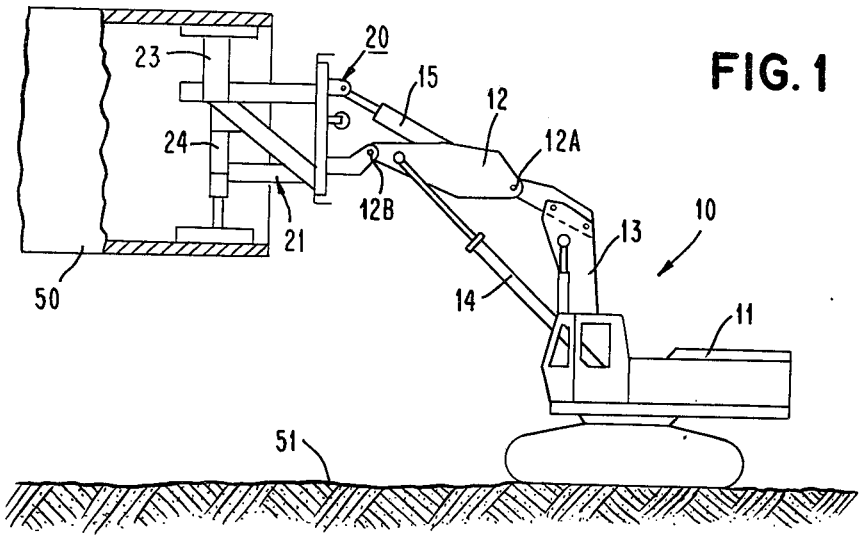
FIG. 1 is a view of a typical piece of earth excavation equipment to which the attachment of the present invention may be connected, and illustrating the attachment in an elevated position.

Referring now to the drawings and especially FIG. 1 thereof, a typical piece of construction or earth moving equipment 10 is illustrated with an attachment 20, constructed in accordance with the present invention, for laying heavy, large diameter pipe 50 in the bottom of an excavation or trench 51. The construction eqiupment 10 may be a typical earth moving or excavation machine such as a Liebherr power shovel or Koehring 1066D hydraulic hoe, and may include a typical operator control cab 11 from which extends the typical boom 12 which is pivotally connected as at 12A to a drive arm 13. The elevation of the boom 12 is controlled by the boom ram 14, the boom typically being connected to a shovel, sloop or bucket at its extended opposite end 12B. The normal scoop is also pivotally connected to the boom 12 as by a tilt ram 15 to control the dig angle of the bucket, and, may be employed in conjunction with the attachment 20 to control the angle of tilt of the attachment.

In accordance with the invention, the attachment 20 includes means for quickly coupling the same to the boom arm 12 as well as the tilt ram 15. When so coupled the attachment may be powered by the conventional hydraulic system incorporated in such earth moving or construction equipment for operator control of pick up and subsequent delivery of the pipe 50 in axial alignment with adjacent pipe sections in the bottom of the trench 51. To this end and referring first to FIGS. 1– 3, the attachment comprises a support frame 21 including a plurality of radially extending arms 22, 23 and 24 projecting from the frame. At the extended terminal ends of the arms 22–24 are support shoes 22A, 23A and 24A which comprise sections of cylinders, the longitudinal axes of which are substantially perpendicular to the arms. As shown, the shoes are arcuate in cross section and have an arc which is substantially equal to the arc of a circle having a diameter substantially that of the concrete pipe which they are intended to enter and embrace for pick up and movement.

Figure 2:
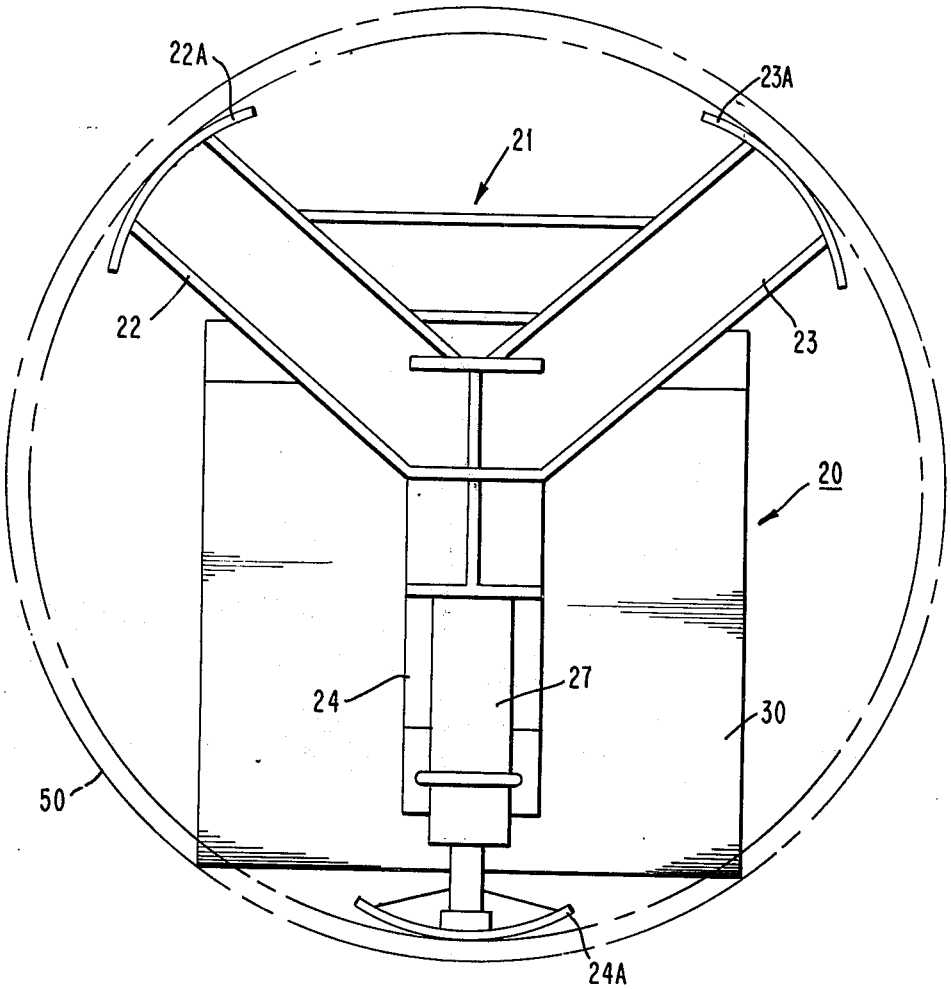
FIG. 2 is an enlarged end elevation view taken along 2—2 of FIG. 1.

As shown best in FIG. 2, the arms are arranged in the form of a "Y" and connected to the support frame 21, the support frame 21 being connected to a platform plate 30, which in turn is connected to a coupling plate 40 (see FIGS. 4 and 5) in such a manner as to permit relative motion therebetween, the coupling plate including means for permitting coupling of the attachment to the construction equipment. To this end and referring now to FIGS. 2 and 3, the support frame 21 includes a first or main support beam 25 connected to the platform plate 30, and a brace beam 26 which serves as a support for the first beam and, in a like manner, is connected to the platform plate. The arm 24 is interrupted, and comprises first actuator means, in the illustrated instance a hydraulic ram having a piston or hard end 27A and a rod end 27B which is coupled to the support and stabilizing shoe 24A. The casing of the piston end of the hydraulic ram 27 is connected to a strut beam 27 which is coupled to the brace beam 26 and the platform plate 30. A butt plate 28 abuts the head or piston end of the ram 27 and, as may best be seen in FIG. 2 is connected to the main or first beam 25. Thus, as shown, at least one of the arms is adjustable radially so as to permit radial expansion of a support shoe interiorly of the concrete pipe system, supporting the pipe for carrying and laying thereof.

In order to support the compression load on the radially extending upper arms of the "Y" shaped arms, a gusset beam 29 is connected intermediate the arms 22 and 23. For ease of viewing in FIG. 3 it should be noted that the arm 23 has been removed.

The platform plate 30 and the coupling plate 40 are designed to permit relative lateral movement between the plates so as to permit lateral adjustment of the concrete pipe carried by the support shoes 22A–24A, the vertical position of the pipe being easily adjusted by the movement of the boom and the angle of the pipe being readily adjusted by the tilt ram heretofore described with reference to FIG. 1. To this end, the platform plate comprises a pair of guides 31 and 32 which coact and cooperate with roller means 41 on the coupling plate 40. As shown best in FIGS. 3, 4 and 5, the guides 31 and 32 comprise a first channel 33 extending rearwardly and along one lateral edge of the platform plate 30, and a second channel 34 along the opposite edge of the plate, each of the channels including a base portion 33A, 34A, and flange portion 33B, 34B projecting from the base portion and an inturned lip portion 33C, 34C respectively, the inturned lip portions being spaced from the base portion to capture and prevent, along with the associated flange and base portions, respectively of the channels, inadvertent removal of the roller means 41 on the coupling plate 40 from the guides thus provided by the channels.

The coupling plate 40, in the illustrated instance, includes the roller means 41 which may be captured in the channels 33 and 34. The roller means 41 comprises two sets of rollers, a first set 43 for contact with and intermediate the base portion 33A and 34A of the channels 33 and 34, the first set of rollers being arranged in the vertical plane to permit rolling action of the coupling plate 40 laterally of the platform plate 30. The roller means 41 also include a second set of rollers

Figure 5:
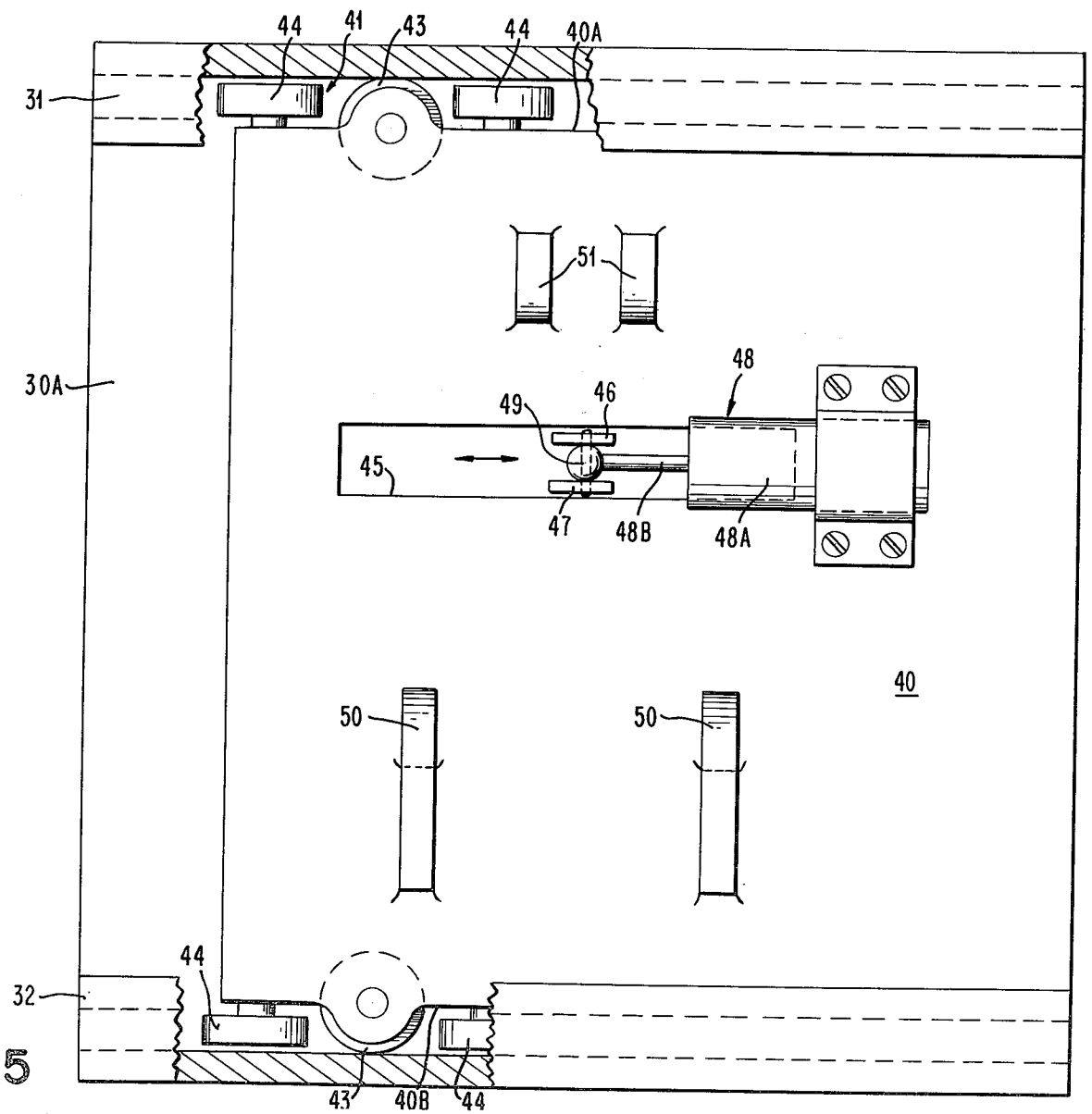

44 mounted along the upper and lower longitudinal or horizontally extending edges 40A, 40B of the coupling plate 40, the second set 44 being captured in the channel 33 and 34, respectively, for contact with the flange portion 33B, 34B of the channels or guides and rear surface 30A of the platform plate 30. In the preferred embodiment, the first set of rollers 43 are interdigitated with the second set of rollers and, as best shown in FIG. 5, the rollers of the first set are arranged orthogonally with respect to the rollers of the second set. Thus the rollers 43 of the first set act to withstand the vertical load of the weight of the pipe being held by the arms 22–24 on the support frame 21, while the second set of horizontally positioned rollers act in conjunction with the flange portions of their respective channels to withstand the movement effect of the load while permitting relative lateral movement of the plates.

Lateral movement of the platform plate 30 with respect to the coupling plate 40 is preferably under operator control. To this end and referring now to FIGS. 4 and 5, the coupling plate 40 includes a horizontally extending slot 45 extending through the plate 40 and registering with a pair of mounts 46 and 47 which extend substantially perpendicular to and are connected to the rear wall 30A of the platform plate 30. A second actuator means is mounted in the illustrated instance on the coupling plate 30, the second actuator means in the present instance comprising a hydraulic ram 48 having a head or piston end 48A and a rod end 48B, the rod end being pinned as to 49 to the mounts 46 and 47 whereby, upon energization of the ram 48, relative movement occurs between the coupling plate 40 and the platform plate 30.

Figure 4:
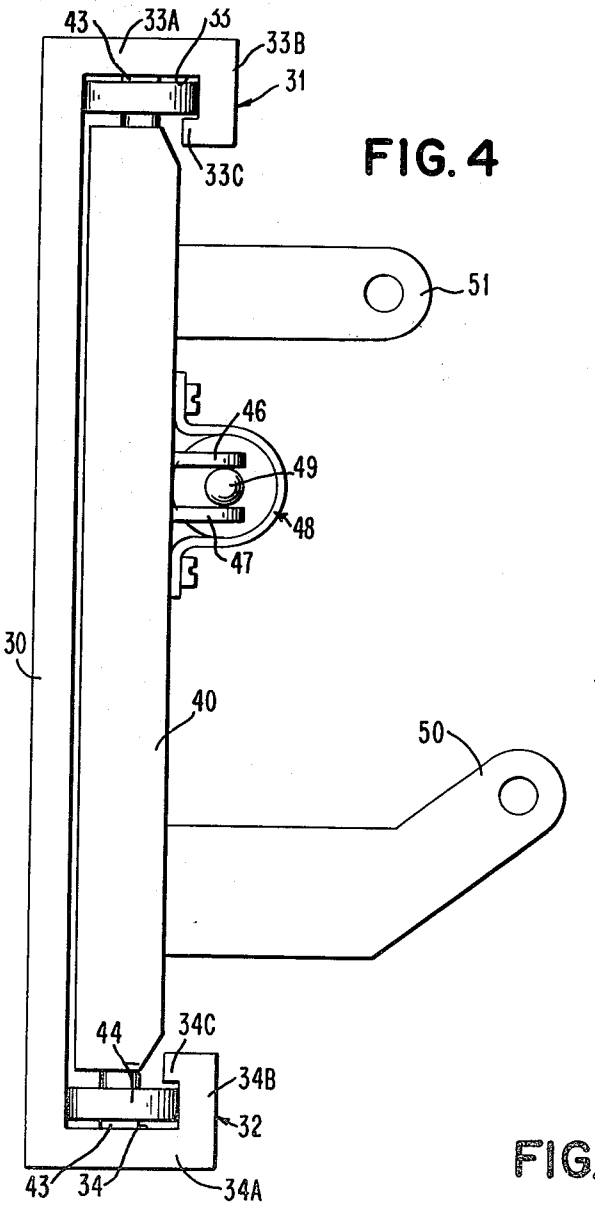
FIG. 4 is a fragmentary side elevational view of a portion of the adapter of the present invention as illustrated in FIGS. 1–3; and, FIG. 5 is an enlarged fragmentary rear elevational view as looking in from the righthand side of FIG. 4.

It should be recognized that the roles of the plates may be reversed, that is, guides or channels may be incorporated on the coupling plate 40 and the rollers positioned on the platform plate 30. However, in the preferred embodiment, the position of the plates is as illustrated in the drawing. In this connection, it is noted that the coupling plate 40 includes a pair of boom mounts 50, which are adapted for quick connection as by a pivot pin (not shown) to the boom 12 of the construction equipment 10 illustrated in FIG. 1. In a like manner, the coupling plate also includes a pair of tilt ram mounts 51 which in a like manner are adapted to be pinned to the tilt ram 15 of the machine illustrated in FIG. 1. Of course, it should be recognized that the mounts may be positioned differently for each particular excavation or construction machine, and the mounts illustrated in FIG. 4 are only illustrative examples of the coupling means necessary for connecting the attachment 20 to the machine.

Thus, the pipe carrying and laying attachment of the present invention may be easily connected to existing excavation and construction equipment, and, by suitable operator control may be placed internally of a large diameter pipe and through control of the third arm or the first hydraulic actuator, expand against the internal surface of the concrete pipe to permit carrying of the pipe and positioning of the pipe by the construction equipment. Once the construction equipment has picked up the pipe and moved it from above the excavation into the trench and placed it approximately in alignment with adjacent pipe sections, a slight lateral movement of the platform plate relative to the coupling plate will permit exact axial alignment of the pipe section. Thereafter the first actuator may be energized by the operator and the shoe 24A retracted so that the attachment may be easily removed from the pipe section.

Figures 3, 3A:
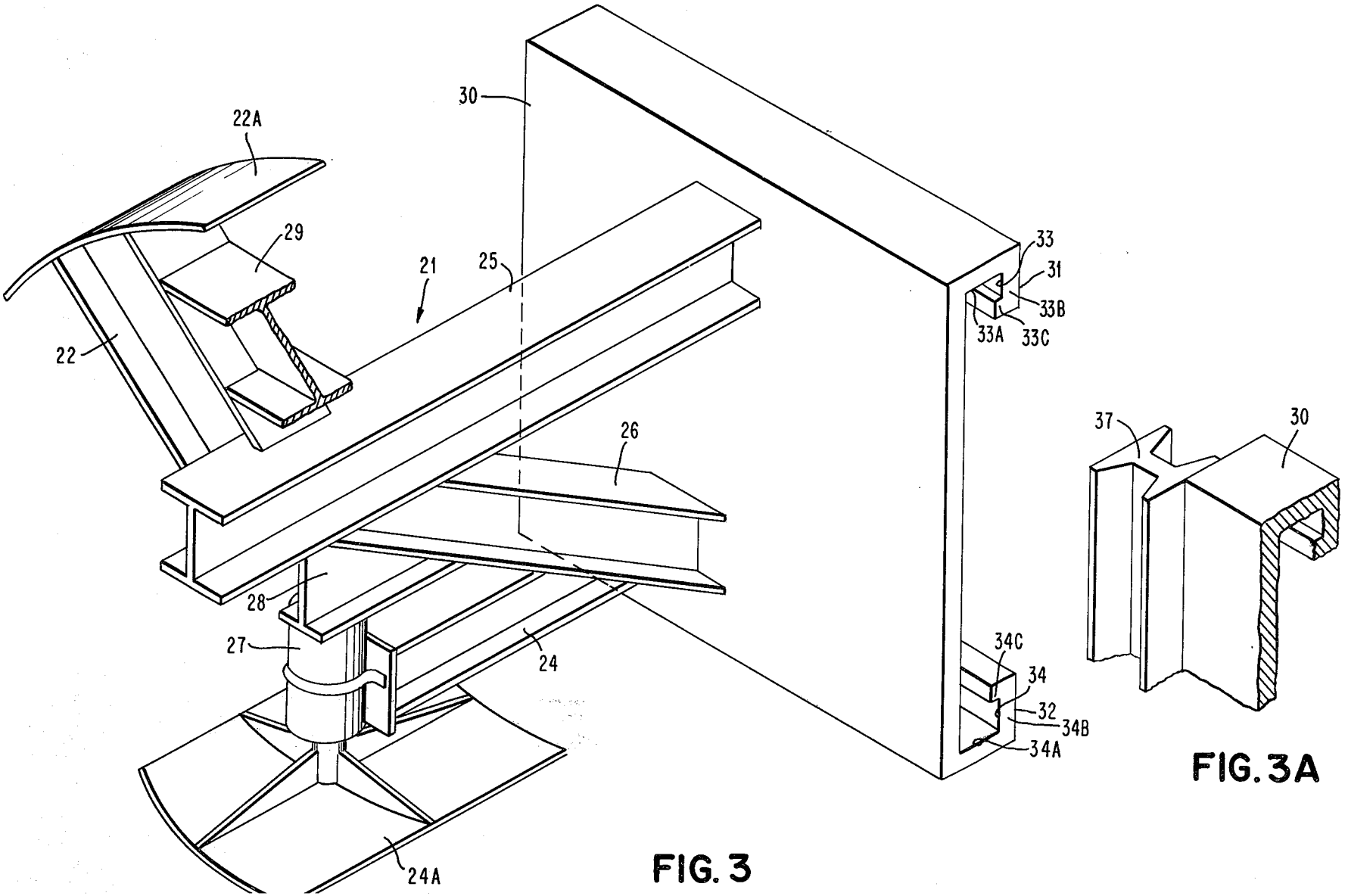
FIG. 3 is an enlarged fragmentary perspective view of a portion of the adapter illustrated in FIGS. 1 and 2.
FIG. 3A is a fragmentary perspective view of a modification of the apparatus shown in FIG. 3.

Additionally, the platform plate 30 may incorporate pusher beams disposed along opposite vertical edges such as along the edges 35 and 36 illustrated in FIG. 3. As shown in FIG. 3A, each pusher beam may comprise a beam 37 extending the height of the plate 30 and offset in the forward direction so that the pipe section may be tamped or pushed into axial abutment with adjacent sections of pipe. This may be accomplished by impinging the pusher beam against a terminal edge or end of the pipe section and using the equipment to which the attachment of the present invention is connected, gently urging the pipe section into axial abutting alignment with adjacent pipe sections.

Although the invention has been described with a certain degree of particularity, it is understood that the disclosure has been made only by way of example and that numerous changes and omissions in the details of construction, the combination and arragement of parts and the mode of operation may be made without departing from the spirit and scope of the invention as hereinafter claimed.

What is claimed is:

1. A pipe carrying and laying attachment for construction equipment, said attachment comprising:

a support frame, a plurality of radially extending arms projecting from said frame, and support shoes at the extended terminal ends of the arms;

at least one of said arms including first actuator means for adjusting the radial position of its associated support shoe;

a platform plate connected to said support frame;

a coupling plate and means connecting said coupling plate to said platform plate for relative movement therebetween;

second actuator means intermediate said coupling and said platform plate for effecting adjustment of said platform plate relative to said coupling plate; and, means on said coupling plate to permit coupling of said attachment to construction equipment.

2. A pipe carrying and laying attachment in accordance with claim 1 wherein one of said coupling plate and said platform plate includes a pair of guides and the other of said plates includes roller means in said guides.

3. A pipe carrying and laying attachment in accordance with claim 2 wherein said guides comprise a first channel along one edge of said plate and a second channel along the opposite edge of said plate, each of said channels including a base portion, a flange portion projecting from said base portion and an inturned lip portion connected to said flange portion and spaced from said base portion.

4. A pipe carrying and laying attachment in accordance with claim 3 wherein said roller means comprises two sets of rollers, a first set for contact with and intermediate the base portion of said guides and a second set for contact with the flange portion of said guides and said plate.

5. A pipe carrying and laying attachment in accordance with claim 4 wherein said first set of rollers is interdigitated with said second set of rollers.

6. A pipe carrying and laying attachment in accordance with claim 4 wherein said first set of rollers is arranged orthagonally with respect to said second set of rollers.

7. A pipe carrying and laying attachment in accordance with claim 1 wherein said support shoes comprise arcuate sections of cylinders, the longitudinal axes of which are substantially perpendicular to said platform plate and said arms.

8. A pipe carrying and laying attachment in accordance with claim 1 wherein said support frame comprises a first beam projecting substantially perpendicular to said platform plate and connected thereto; a brace beam connected to said first beam and said platform plate, at least one of said arms being connected to said first beam.

9. A pipe carrying and laying attachment in accordance with claim 8 wherein said plurality of arms comprises three arms arranged in the form of a "Y," at least a pair of said arms comprising beams connected to said first beam, and said support shoes comprise arcuate sections of cylinders, the longitudinal axes of which are substantially perpendicular to said platform plate.

10. A pipe carrying and laying attachment in accordance with claim 9 wherein said first actuator means comprises a hydraulic ram, means mounting said ram to said platform plate, said ram including an actuator rod having a support shoe at the extended end thereof.

11. A pipe carrying and laying attachment in accordance with claim 10 wherein said means mounting said ram to the platform plate comprises a strut connected to said plate at one end and to said ram at the other end, and a ram butt plate intermediate said first beam and said ram.

12. A pipe carrying and laying attachment in accordance with claim 9 including a gusset beam intermediate said pair of beams connected to said first beam, and connected to said pair of beams.

13. A pipe carrying and laying attachment in accordance with claim 1 wherein said second actuator means comprises a hydraulic ram including a head end portion and a rod portion, means mounting said head end portion on one of said plates and means connecting said rod to the other of said plates whereby, upon actuation thereof, relative movement occurs between said plates.

14. A pipe carrying and laying attachment in accordance with claim 2 wherein said second actuator means comprises a hydraulic ram having a piston head end and a rod end, a slot in one of said plates extending parallel to at least one of said guides, means coupling said rod end through said slot in the other of said plates, and means connecting the piston end to one of said plates.

15. A pipe carrying and laying attachment in accordance with claim 3 including pusher beams mounted on said platform plate perpendicular to said channels, and offset with respect to the plain of said plate.

* * * * *